US008079352B1

(12) United States Patent
Veracka et al.

(10) Patent No.: US 8,079,352 B1
(45) Date of Patent: Dec. 20, 2011

(54) ELECTROMAGNETIC DECOY LAUNCHER

(75) Inventors: Michael J. Veracka, Annapolis, MD (US); Craig N. Boyer, Mitchellville, MD (US); Jesse M. Neri, Gaithersburg, MD (US); Raymond J Allen, Vienna, VA (US); Irwin L. Singer, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 40 days.

(21) Appl. No.: 12/822,826

(22) Filed: Jun. 24, 2010

Related U.S. Application Data

(60) Provisional application No. 61/219,907, filed on Jun. 24, 2009.

(51) Int. Cl.
*F41F 1/00* (2006.01)

(52) U.S. Cl. ..... 124/3; 89/8

(58) Field of Classification Search ..... 124/3; 89/8
See application file for complete search history.

(56) References Cited

U.S. PATENT DOCUMENTS 1,370,200 A * 3/1921 Fauchon-Villeplee ..... 124/3
1,422,427 A * 7/1922 Fauchon-Villeplee ..... 124/3
4,347,463 A * 8/1982 Kemeny et al. ..... 318/135
4,677,895 A * 7/1987 Carlson et al. ..... 89/8
4,796,511 A * 1/1989 Eyssa ..... 89/8
4,967,639 A * 11/1990 Hughes et al. ..... 89/8
5,237,904 A * 8/1993 Kuhlmann-Wilsdorf ..... 89/8
5,285,763 A * 2/1994 Igenbergs ..... 124/3
5,375,504 A * 12/1994 Bauer ..... 89/8
7,077,047 B2 7/2006 Frasca
7,398,722 B1 * 7/2008 Sims, Jr. ..... 89/8
7,409,900 B1 8/2008 Nechitailo et al.
7,730,821 B2 * 6/2010 Taylor ..... 89/8
2007/0277668 A1 12/2007 Frasca
2007/0277797 A1 * 12/2007 Ignatiev ..... 124/3
2008/0053299 A1 3/2008 Taylor

OTHER PUBLICATIONS

U.S. Appl. No. 12/822,794.

* cited by examiner

*Primary Examiner* — Troy Chambers
(74) *Attorney, Agent, or Firm* — Amy L. Ressing; L. George Legg

(57) ABSTRACT

An electromagnetic rail gun launcher for launching an armature attached to a projectile includes a barrel, having a bore, and a body that includes a pair of main rails, a first pair of augmenting rails one of each lying outboard of and coextending with each of one of the main rails from the breech to the muzzle, a second pair of augmenting rails one of each lying outboard of and coextending with one of each of the first pair of augmenting rails, a first pair of electrically-conducting crossovers proximate to the breech and a second pair of electrically-conducting crossovers proximate to the muzzle and connected in series when the armature is positioned in the bore with power provided to the launcher. The exit speed of the projectile from the launcher is controlled by controlling the current to the launcher.

22 Claims, 10 Drawing Sheets

ELECTROMAGNETIC DECOY LAUNCHER

CROSS-REFERENCE TO RELATED APPLICATIONS

This application claims the benefit of U.S. Provisional Application 61/219,907 filed on Jun. 24, 2009, and incorporated herein by reference. This application is related to U.S. application Ser. No. 12/822,794, filed concurrently herewith on Jun. 24, 2010.

FIELD OF THE INVENTION

The invention is directed to an electromagnetic launcher system for propelling projectiles at low to medium velocity using electrically generated magnetic fields. More particularly, the invention is directed to the deployment of offboard expendable decoys as a countermeasure for the protection of naval ships and aircraft from infrared guided missiles.

BACKGROUND OF THE INVENTION

The current operational methods of launching decoys from US Navy ships are the RBOC and SRBOC countermeasure launchers. Both use a chemical propellant to accelerate a round to the desired velocity. They are fixed in azimuth and elevation and the velocity is determined by the amount of propellant and weight of the round. As such, they are limited in their effectiveness because they cannot be deployed at the best distance and angle to counter an approaching threat. The rounds used in the launcher cannot be tailored for the platform from which it is launched.

The current operational method of launching decoys from US Navy aircraft is the ALE-40 countermeasure dispenser. This dispenser usually ejects decoys from the bottom of the aircraft straight down. The decoys are launched with no forward velocity component and separate from the aircraft quickly. Advanced threats can use these characteristics to discriminate the decoy from the target and reject the decoy.

A launching system heretofor employed and designed solely for launching munition-type projectiles is an electromagnetic rail gun. In electromagnetically-driven rail guns, two metallic rails in the gun barrel (bore) serve as electrodes that conduct current to a conducting armature wedged tightly between the rails. The armature is placed at the back of the projectile that delivers a payload. A fast, high-current pulse loops through the rails via the armature, generating a magnetic field that couples with the current passing through the armature to produce a force that accelerates the projectile down the barrel at supersonic speeds.

Exemplary rail gun designs are described in U.S. Pat. No. 7,409,900. Nechitailo et al. issued Aug. 12, 2008; U.S. Pat. No. 7,077,047, J. F. Frasca, issued Jul. 18, 2006; U.S. Patent Application No. 20080053299. R. J. Taylor, publication date Mar. 6, 2008; and U.S. Patent Application No. 20070277668, J. F. Frasca, publication date Dec. 6, 2007; all of which are incorporated herein by reference. These rail gun designs, however, are not focused on the specific issue of how best to launch an electronic countermeasure such as a decoy. For example, as discussed above, the projectile in prior systems is accelerated down the barrel at supersonic speeds.

The speeds required for decoy launching are variable but typically a fraction of those required for munition-type projectiles. The chemical propellant used in these systems also has the known safety concerns of handling the charge along with the safety and logistical (e.g. supply chain) issues involved in storing and replacing the charges.

It would therefore be advantageous to provide an electromagnetic rail gun system for safely launching a decoy at user-selected launch velocities and angles.

BRIEF SUMMARY OF THE INVENTION

According to the invention, an electromagnetic rail gun launcher for launching an armature attached to a projectile includes a barrel, having a bore, and a body that includes a pair of main rails, a first pair of augmenting rails one of each lying outboard of and coextending with each of one of the main rails from the breech to the muzzle, a second pair of augmenting rails one of each lying outboard of and coextending with one of each of the first pair of augmenting rails, a first pair of electrically-conducting crossovers proximate to the breech and a second pair of electrically-conducting crossovers proximate to the muzzle and connected in series when the armature is positioned in the bore with power provided to the launcher. When current is provided to the rails with the armature positioned in the bore at the breech, a magnetic field is generated in the bore and a current is introduced into the armature that is perpendicular to the magnetic field to produce a force on the armature in the direction of the muzzle and thereby propel the armature with attached projectile through the bore and out of the launcher at a selected velocity in a selected direction.

The EM launcher utilizes an expendable projectile, which in one embodiment is an electronic countermeasure, i.e. a decoy. The projectile can also be something other than a decoy. e.g. a firework or other aerial device. The launcher can include an automatic and/or computerized launching system, and the computer launching software program can also include instructions that when executed by the computer cause the launcher to follow a desired sequence. e.g. so as to "paint" a desired decoy image pattern, aerial display, or fireworks display.

The invention provides an improved system and method for the deployment of onboard expendable decoys as a countermeasure for the protection of naval ships and aircraft from infrared guided missiles. The invention can further be used for any expendable countermeasure. The invention can be used to propel any suitable projectile to a velocity in the 100-300 m/s range. Scaled up versions of invention can be made to attain proportionally higher velocities.

A novel advantage of the electromagnetic ("EM") launcher is the capability to vary the velocity of each shot independently, as opposed to the prior art method of launching decoys relied upon a fixed amount of chemical propellant and a fixed time delay before functioning so the distance from the aircraft or ship was the same amount regardless of conditions which may be changing. With the EM launcher, aircraft flying at different speeds are able to control the distance from the aircraft at which the decoy will function. Decoy rounds from ships using prior art systems are limited to a range that is about the same distance for each round. The EM launcher of the invention has the capability to vary the distance the decoy functions at to therefore provide a complex false target with spatial extent or create the illusion of motion for materials with a time dependant signature.

Another advantage is the deployment of decoys without the use of explosives or pyrotechnics, thereby providing a saner system while also eliminating the logistical and costly step of replacing and resupplying the spent materials.

DETAILED DESCRIPTION OF THE INVENTION

Figure 1:
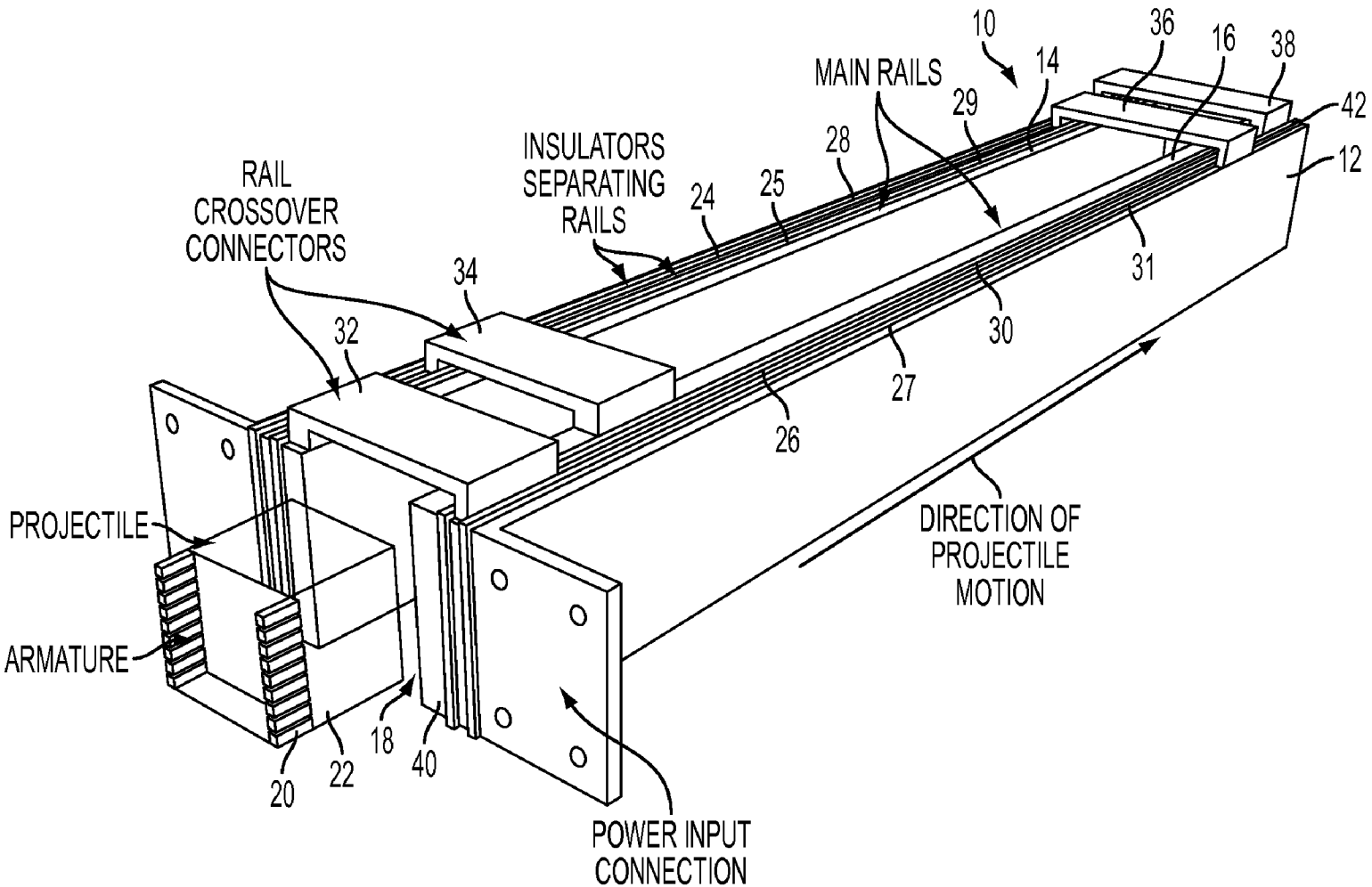
FIG. 1 is an elevational view of an electromagnetic rail gun launcher according to the invention.

A railgun is a type of linear motor. Like motors, there is a stator, the rails, and an armature, which is attached to the projectile. The armature connects the rails together electrically. The interaction of the current flowing through the armature with the magnetic field generated by the current flowing through the rails results in a force on the armature parallel to the rails.

In one embodiment, the electromagnetic rail decoy launcher (EMDL) is an augmented launcher with one set of main rails and one set of augmenting rails. In general, the efficiency of rail guns scales with velocity. Since the application envisioned for the electromagnetic launcher is the deployment of decoys, which must be near the platform the decoys are intended to protect, the exit velocity is necessarily low (80 to 150 m/s). The technique of augmenting the main rails of the launcher with additional rails creates a larger magnetic field in the barrel of the launcher. By connecting the augmenting rails electrically in series with the main rails, the same current is used by all the rails to generate the magnetic field.

However, using additional augmenting rails in series increases the electrical resistance of the launcher, which lowers its efficiency. Accordingly, in another embodiment shown in FIG. 1 that includes an additional pair of augmenting rails, the electromagnetic rail decoy launcher (EMDL) 10 has a barrel 12 integrated into which are main rails 14 and 16 that are spaced apart so as to form a bore 18 therebetween for slidably receiving an armature 20 to which is attached a projectile 22, for example an electronic warfare countermeasure device such as a decoy to launch from a ship or an aircraft. Launcher 10 includes augmenting rails 24, 25, 26 and 27 (2 pair) separated from main rails 14 and 16 and one another by insulators 28, 29, 30, and 31. Rail crossover connectors 32, 34, 36, and 38 electrically connect the sets of rails as shown such that when energized, current flows through the rails and a large magnetic field is generated. The armature 20 carries a current perpendicular to the magnetic field with a resultant force that acts on armature 20 to move from a breech 40 to a muzzle 42 of launcher 10 and thereby launch the projectile 22 at its design exit velocity.

Although armature 20 as shown and described is expended upon the launch of projectile 22, in an alternative embodiment, armature 20 is adapted to releasably secure projectile 22 such that when armature 20 reaches muzzle 42, détente means (not illustrated) stop armature 20 so as to retain it within bore 18 while releasing projectile 22.

Figure 2:
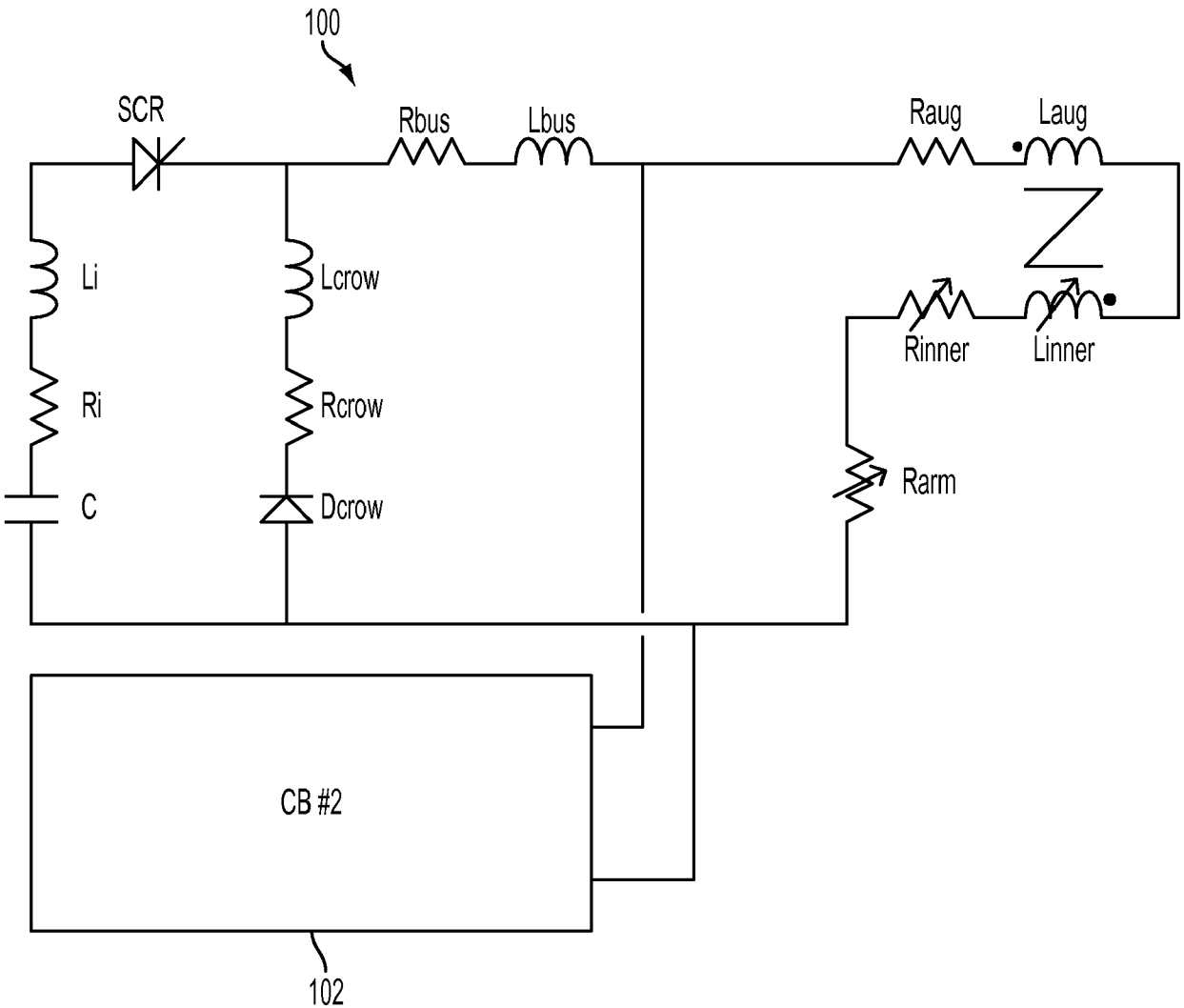
FIG. 2 is a circuit diagram for a launcher according to the invention.
Figure 3:
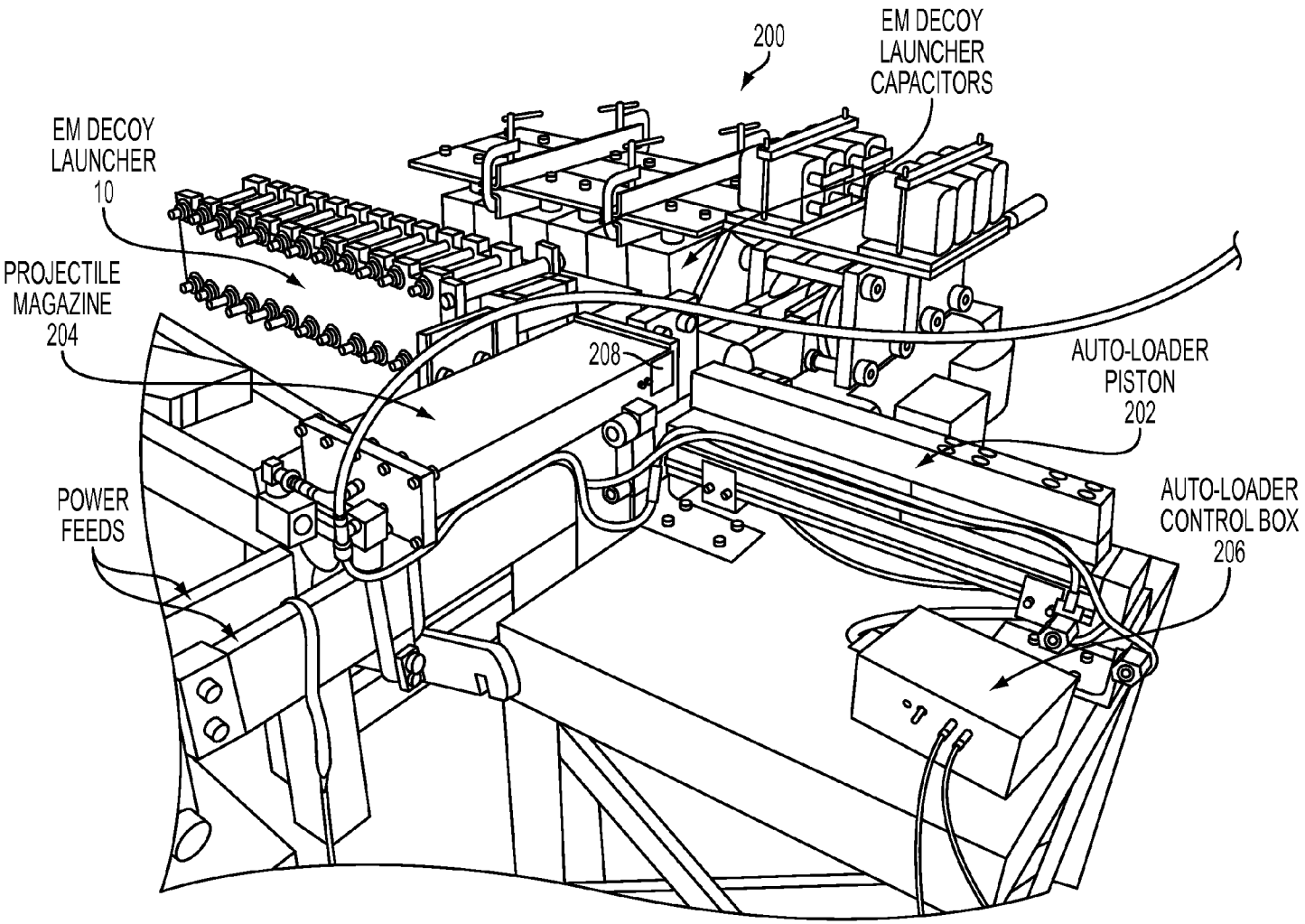
FIG. 3 is an elevational view of a decoy launcher system according to the invention.

FIG. 2 is a circuit diagram showing a representative power supply 100 configuration for launcher 10. A capacitor bank 102 charged by batteries or other power means. A high-power, rapid capacitor charger is preferred for shot availability and for high repetition rate burst mode operation. The power source is converted to capacitor charge by the rapid charger. This is further described below. FIG. 3 shows a decoy launcher system 200 that in addition to launcher 10 includes an autoloader piston 202 positioned alongside a projectile magazine 204, preloaded with a plurality of armatures with their attached projectiles. Piston 202 and magazine 204 are both connected to and controlled by an autoloader control box 206 designed to sequentially urge each armature 20 with attached projectile 22 into a magazine opening 208 through which piston 202 loads it into the breech 40 of launcher 10.

The system of FIGS. 1-3 was tested and found capable of delivering a mass of 340 g to a velocity of 140 m/s.

The best mode of the invention is launching expendable decoys from a ship or an aircraft. A magazine filled with decoys is situated at the breech end of the electromagnetic (EM) launcher. When a decoy is needed, a decoy is loaded into the launcher while the capacitor bank is charged to the appropriate level needed. This is determined by the velocity of the aircraft or distance from the ship the decoy needs to function. When the charge level is reached, the switch closes and the energy in the capacitor is discharged into the EM launcher. When the current flows through the rails, a large magnetic field is generated. The armature attached to the decoy carries a current perpendicular to the magnetic field and experiences a force in the direction of the muzzle. This force propels the armature/decoy through and out of the launcher. The velocity can be controlled by the amount of charge stored in the capacitor bank. If a fuse of fixed time duration controls when the decoy functions, the velocity will control the distance at which it functions. In this way, decoys can be made to function at precise distances from the launcher.

FIGS. 1-3 show the EMDL embodiment with two sets of augmenting rails on the EM launcher, although the method of connecting the crossovers to form a series circuit allows any number of augmenting rails to be so connected.

Figure 4A:
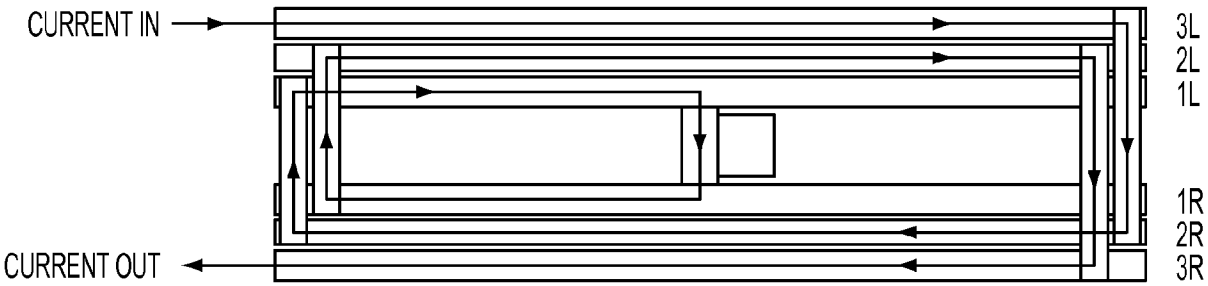
FIGS. 4A-B shows the launcher system with the connections for two and three sets of augmenting rails according to the invention.
Figure 4B:
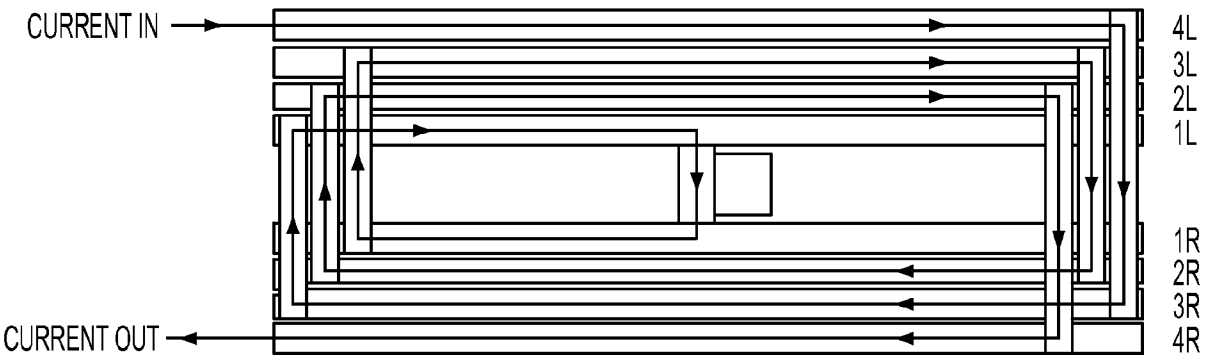

Referring now to FIGS. 4A-B, the current flow is shown through the launcher 10 of FIG. 1 (FIG. 4A) and also through a launcher with a third pair of augmenting rails and electrically-connecting crossovers (FIG. 4B). The rails are labelled 'L' and 'R' to indicate left and right, respectively, of the bore in the direction of travel of the projectile. The crossovers in each embodiment connect the sets of rails in series as shown so that when power is applied, the current flows through the rail and the armature whereby the magnetic field is generated in the bore perpendicular to the current flow through the armature to produce a force on the armature in the direction of the muzzle. In this same manner, any number of additional pairs of augmenting rails with crossovers may be added so as the connect the rails and armature in series.

Accordingly, EM launchers with three, four, or more sets of augmenting rails are also within the scope of the invention. The augmenting rails increase the magnetic field but also increase electrical resistance. When adding rails proportionally increases resistance more than magnetic field then there is less benefit to adding additional rails. Shortening the launcher to make up for the added resistance then permits adding additional augmenting rails and obtaining the increased magnetic field with a lesser increase in the electrical resistance.

Whereas most prior rail guns use aluminum armatures and some form of copper rails, the rails of the EMDL are preferably made of Glidcop®, a copper made harder by the addition of a small amount of aluminum oxide. When a rail gun is operated, the aluminum armature's surface melts before the rails thereby minimizing damage to the rails, but leaving a residue of aluminum on the rails. With a low velocity launcher such as the EMDL, this residue build up added electrical and mechanical resistance to the system. After a few shots, the launcher needed to be disassembled and the rails resurfaced. Conducting lubricants were tested to try to avoid the transfer of aluminum to the rails, but to no avail.

Figure 5:
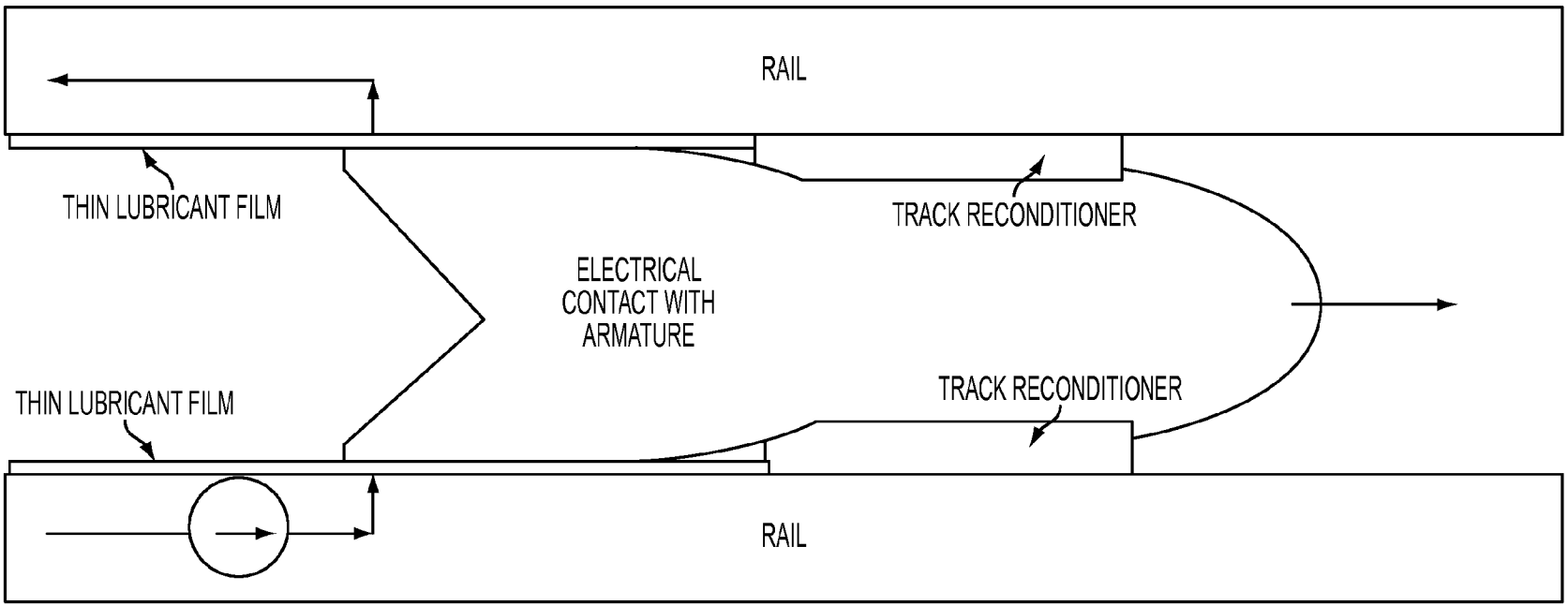
FIG. 5 is a cross-sectional view of a rail gun track system with lubrication pads according to the invention.
Figure 6:
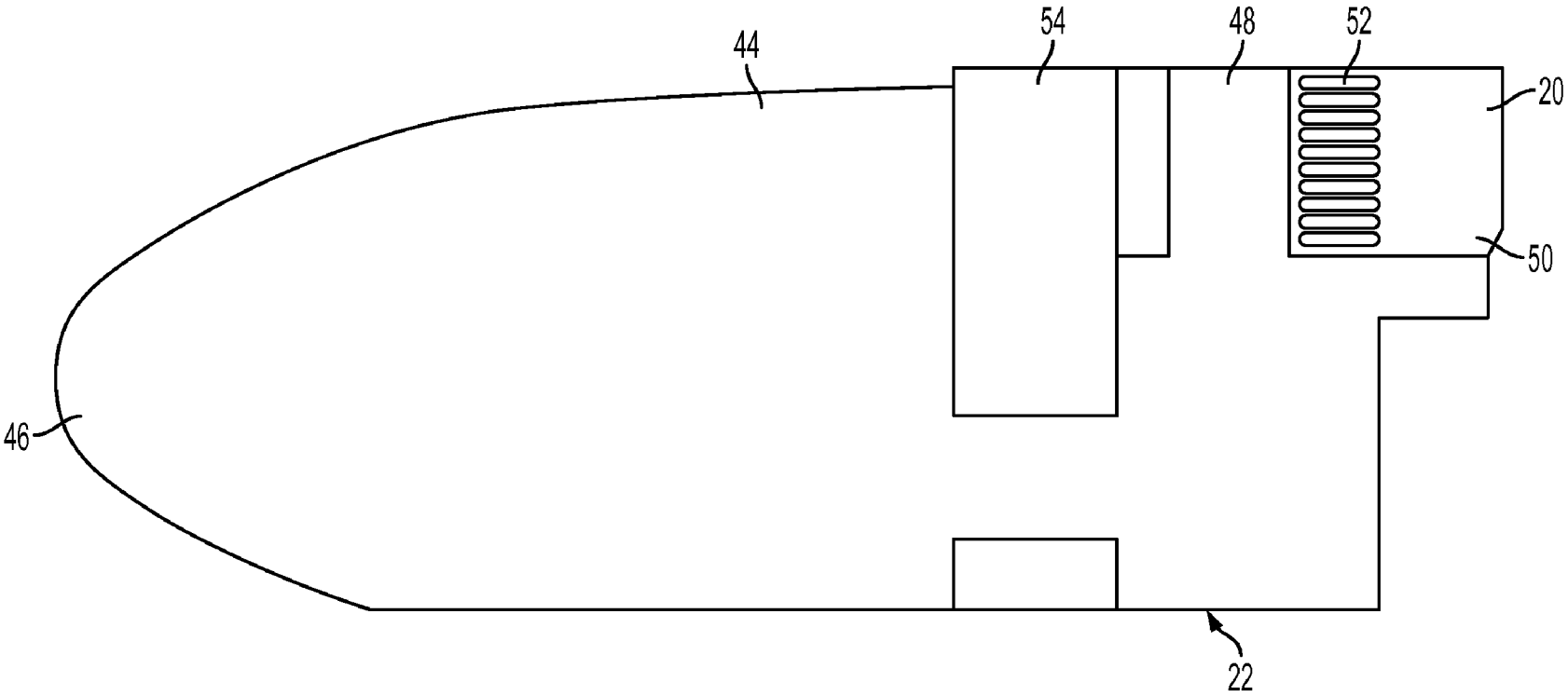
FIG. 6 shows an armature-projectile with lubricating/conditioning pads according to the invention.
Figure 7:
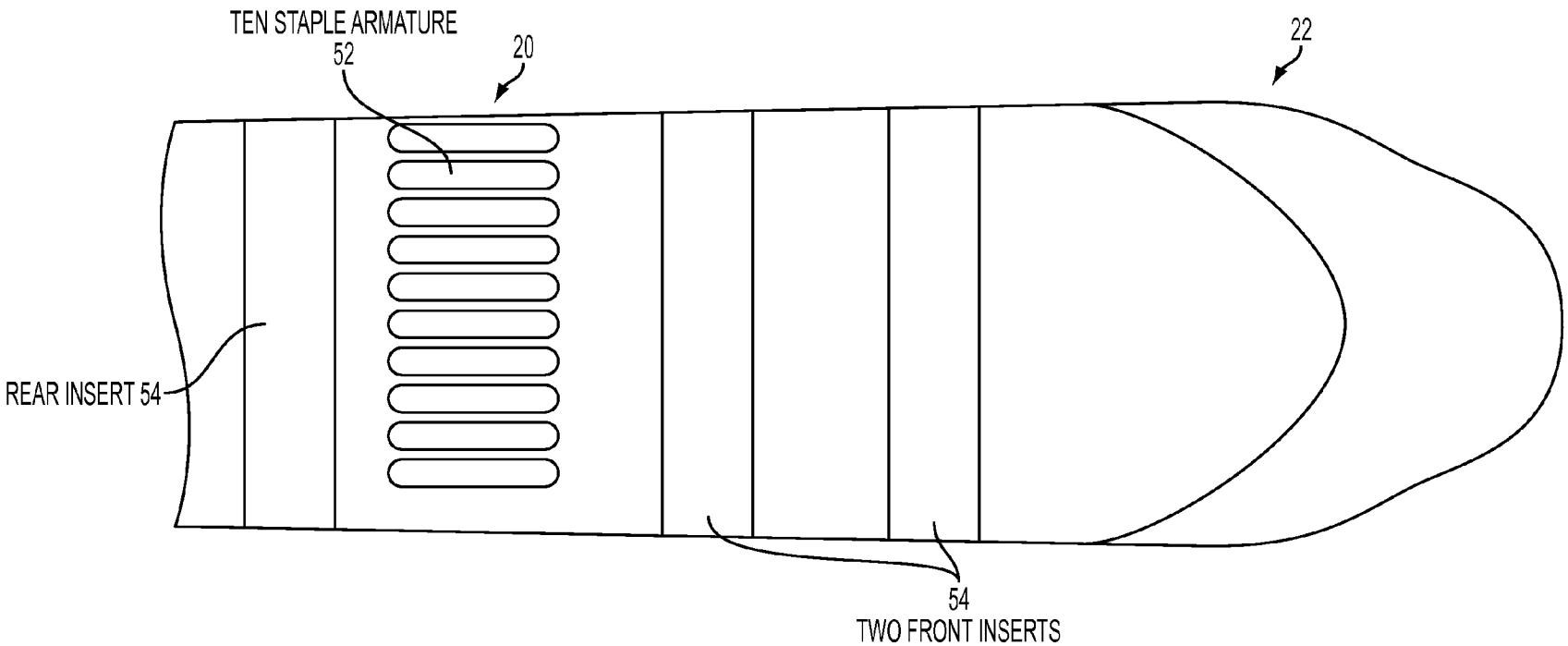
FIG. 7 shows an armature-projectile with lubricating/conditioning pads positioned fore and aft of the armature according to the invention.

Referring now to FIGS. 5-7, in one embodiment the projectile 22 has a body 44 having a bullet-type geometry, that is, with a tapered nose portion 46 and where body 44 has a geometry so as to be fit into and be slidably received within bore 18, which in the embodiment shown in FIG. 1 accepts a square cross-sectional body 44 (although of course it should be understood that other mutually compatible (projectile-bore) geometries are also within the scope of the present invention). Each of eight conductive copper wires is threaded into a hole drilled into the top surface 48 of projectile 22 at its aft end 50 and bent into a receiving slot milled into surface 48 that extends aft from the drilled hole to thereby form eight armature conducting contacts or "staples" 52 that together make up armature 20 (each contact is alternatively referred to as a "staple" because its geometry resembles a staple or at least part of a staple, in that it has two lengthwise portions, positioned in the milled slot, and one 90 degree bent end positioned in the drilled hole). Body 44 is fabricated from a nonconducting material, and for test purposes and ease of fabrication was Delrin®, a hard acetyl plastic material capable of withstanding the forces in the tested application. The exposed surface of each staple 52 was ground flat, then sanded with 400 then 600 grit carborundum (SiC) paper, then buffed to a bright finish by a cloth charged with rouge, and then cleaned with acetone. Staples 52 were then wiped with dilute acetic acid and then hand-rubbed with Rulon®, a lubricant and reconditioner further described below.

Body 44 also includes a Rulon insert lubricant and reconditioning pad 54 that serves to a) wipe and clean debris from the rail surface, b) texture the surface to reproduce an interfacial topography that optimizes electrical contact, and c) apply a fresh layer of lubricating film ahead of the armature/rail electrical contact. To insure that the reconditioning pad makes contact with the rail during the projectile's flight down the barrel, it should be relatively compliant for the following reason: After sliding begins, electrodynamic forces can subject the projectile to horizontal and vertical motions that displace the reconditioning pad from the rail. By choosing the proper compliance, the pad 54 will remain in contact with the rail during the projectile's flight down the barrel. Two methods of adjusting the compliance are proposed. First, the entire pad 54 should be spring-loaded against the rail by, for example, a thin piece of compliant rubber, e.g. rubber with elastic modulus from 0.2 to 20 MPa. This will insure that the pad 54 can remain in contact with the rail even when the armature and rail become displaced. A second method is to lower the compliance of the surface of the pad 54 at the sub millimeter scale. The reconditioning pad surface can be made much more compliant (softer) by 'texturing' the pad 54. For example, one could cut narrow channels in the pad's surface with microtome blades or razor blades. This would create flexible sheets of the pad material some 0.1 to 2 mms tall, attached to the bulk of the pad 54. In addition to the one or more fore-mounted pads 54 projectile 22 may also include a pad 54 mounted aft, that is, in back of (with respect to the motion of travel through bore 18) armature 20, that operates to wipe away debris and oxide formed at the staple/rail interface as projectile 22 traverses bore 18.

The current needed to launch the full mass projectile to 140 m/s was in excess of 300,000 amps for the single augmented launcher. The aluminum wires used as the armature could fail at such high currents. An armature was changed to copper to handle the current. The rails as the armature were conditioned with the rulon lubricant as well. The lubricant worked with the copper armature also but the rails still needed resurfacing after a dozen shots. By incorporating a lubricant pad into the projectile itself, lubricant was applied to the rails with each shot, thus extending the time before rail resurfacing was needed.

The high current of the launcher creates electrical stress and heat on all the components of the system, as well as limiting the lifetime of the rails. By adding another set of augmenting rails, a larger magnetic force is created, thus enabling the use of lower current for the same projectile velocity. As mentioned above, this increases the resistance. This problem was solved by laminating the augmenting rails. Three thin conductors in parallel insulated from one another and connected together at the ends increased the surface area and decreased the resistance of the rails. By doing this to all the augmenting rails, the magnetic field increases more than does the electrical resistance, allowing the current to be reduced. The EMDL launcher 10 with the two sets of augmenting rails achieved a velocity of 140 m/s with 160,000 amps.

Figure 10:
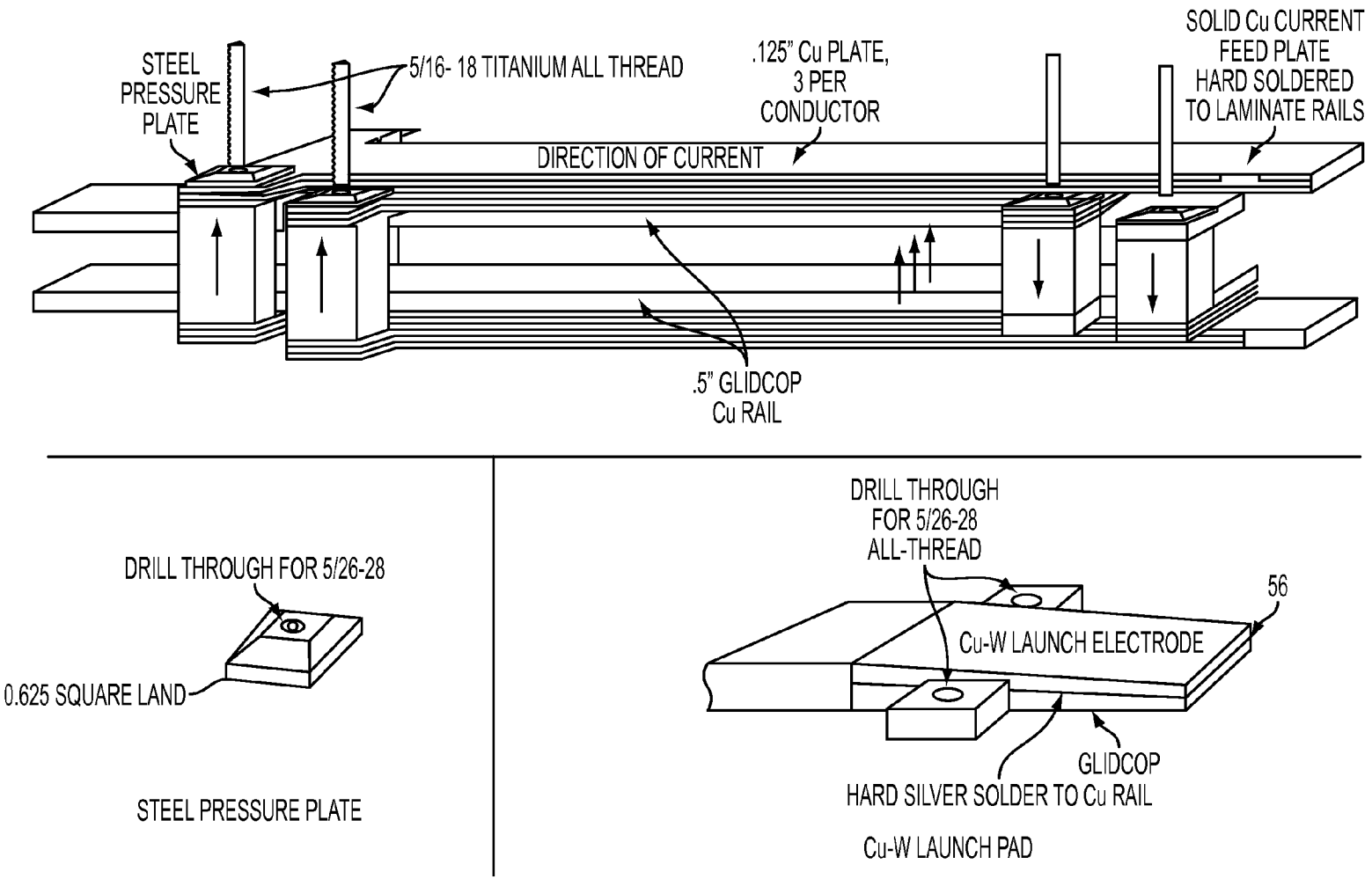
FIG. 10 shows the construction of components of the launcher according to the invention.

The lower current decreases the damage to the rails as the armature slides through the launcher barrel. However, the rails suffer damage from the armature when the current is first applied but before the projectile is moving. To prevent this startup damage, a block 56 made of copper-tungsten alloy is incorporated into the rails at the breech—this and other details of the construction of launcher 10 are shown in FIG. 10. This material is much harder than copper and resists damage during startup. This block is preferably placed at an angle such that the entrance to the breech is slightly wider than the rails, thus lowering the force necessary to insert the projectile into the gun. When the current is applied to the launcher, the projectile moves down the startup block, which narrows to the nominal launcher barrel diameter, and proceeds onto the Glidcop material of the main rails. Thus the projectile experiences less mechanical friction at loading and uses the magnetic force of the gun to compress the armature to its final width in the barrel. Since the armature is always moving when in contact with the Glidcop, rail damage is further lessened.

It should be noted that the dimensions called out in FIG. 10, which are in inches are an example of the present embodiment which is a launcher about 3 feet in length. However, the launcher can be scaled to any size appropriate for the desired velocity range or amount of mass launched.

All of the solutions described above contribute to extending the life of the rails. The launcher 10 launched in excess of 100 shots on the same set of rails, while stopping short of establishing an upper limit on useful lifetime.

Figure 8:
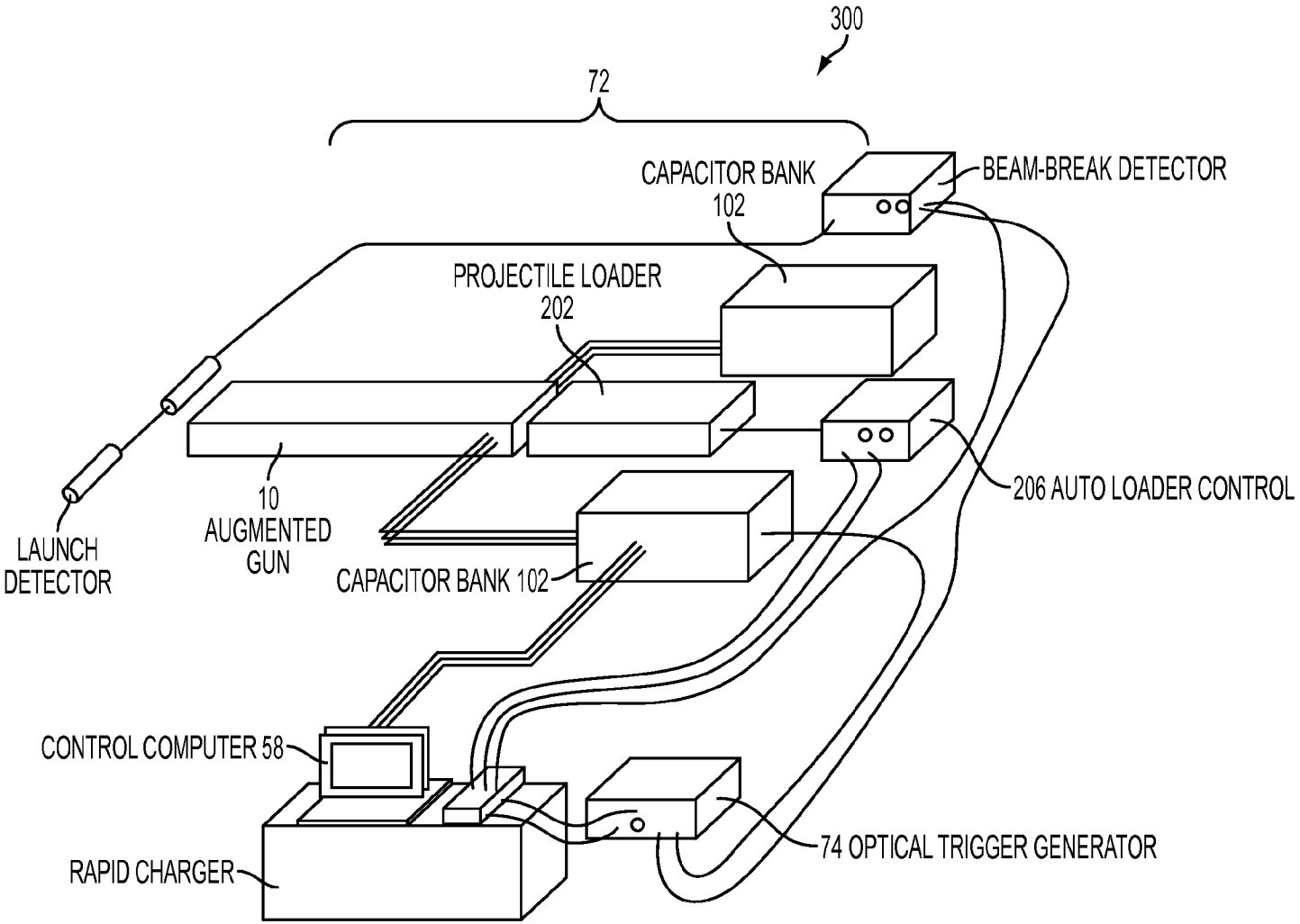
FIG. 8 shows the connections from the launcher system to the computer for controlling the output of decoys according to the invention.
Figure 9:
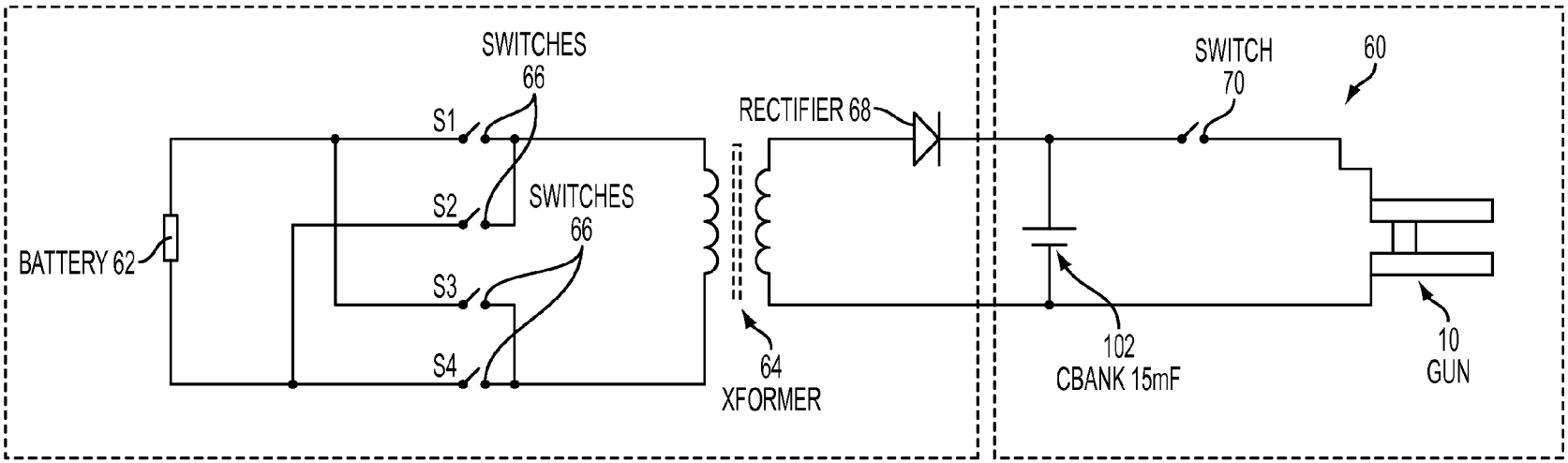
FIG. 9 is a circuit diagram of a charger according to the invention.

The projectile loader system shown in FIG. 3 was constructed to hold six projectiles and to be controlled remotely. The loader operates using compressed gas and a series of solenoid valves. The loader pushes the projectile into the launcher 10 the correct distance and then the piston retracts. Referring also now to FIGS. 8-9, the autoloader piston 202 is controlled by software installed on a computer 58, that synchs with the autoloader control 206, and that also includes instructions to control the operation of a charger 60. Any type of loader that is compatible with the electrical characteristics of the gun may be used.

The launcher has to be able to operate for multiple shots in a very short timeframe. With a single augmented gun, the capacitors that store the launch energy initially took about five minutes to charge. The double augmented launcher 10 uses the current more efficiently so it requires less charge to achieve the desired velocity. The charger 60 charges the system in about 0.9 seconds. Charger 60 includes a battery 62 such as multiple lead acid batteries connected in series, the direct current (DC) from which is routed through four IGBT switches 66 in an H-bridge configuration that alternately reverse polarity on the transformer primary at high frequency to convert DC to AC. An output rectifier 68 (e.g. a full bridge) then converts the higher AC at the transformer secondary into the DC output current. The DC output current then rapidly charges the capacitor bank 102 of the launcher 10 to high voltage where it is switched into the gun via switch 70 to launch the projectile. The isolating feature of both the transformer 64 and the rectifier 68 allows for multiple chargers 60 to be placed in parallel to increase the total output power.

The launch system 300 of FIGS. 1-3 and 8-9 was tested utilizing as the battery 62 a battery bank broken up into four series strings of four lead acid batteries each, recharged by a conventional 48-V battery charger (not illustrated). Faster charge times can be achieved by using more batteries but at the expense of adding additional weight. The use of lithium batteries would lower the weight by at least one third at the expense of greater complexity and cost. Any suitable batteries can be used. The system must be capable of fast cycling time to create the desired effect. The control computer 58 in a primary function controlled the timing of the IGBT switches 66. About a 1-μs off time was applied between switching on the alternate sets of H-bridge switches, to achieve accurate timing with 1-μs resolution. Computer 58 utilized a general-purpose, eight-core Propeller microcontroller from Parallax. Launch system 500 was tested by charging the full railgun capacitor bank with a measured capacitance of 16.6 mF. The resulting average charging output power to the railgun was then about 58 kW. Variable H-bridge switching was incorporated into the control system to optimize performance. Three switching frequencies were tested and found to work well: 2.27, 4.5 and 9.1 kHz. Optimal switching frequency was found to be a function of the output voltage, where at high voltage a higher switching frequency is preferred, while at low voltage a lower switching frequency can provide as good as or better performance by exhibiting decreased switching loss. Launch system 300 further included a photobeam launch detector 72 connected to an optical trigger generator 74 and to the autoloader control 206 for automatically controlling the sequential loading and launching.

As discussed, computer 58 is configured for running a software program that operates the launcher, loader and charger. The software program-controlled EMDL is capable of launching a number of projectiles automatically. The charge the capacitors store for each shot is controlled by the software. By varying the charge on the capacitors, the exit velocity of the decoy rounds is also varied. If there is a set delay after the decoys exit the launcher before the decoys function, the decoys will function at different distances from the launcher. This allows the creation of images in space away from the launching platform which appear to threats to be credible targets. By also varying the azimuth and elevation of the launcher, an image can be created in any orientation relative to the platform. This spatial image painting can be made with more resolution with smaller decoy payloads.

For example, to protect a ship from infrared guided missiles, different materials can be used to create the appearance of various parts of the ship having different temperatures. Hotter materials can be used for the stack image, and cooler materials can be used for the hull image. Obscurants can be dispensed via additional decoys to allow the ship to be screened after the false image has been created, thus decreasing its visibility to the threat. Materials that work in radio frequency or millimeter wave domain can be dispensed to co-locate the appropriate signatures for use against missiles with multiple modes of guidance.

In another embodiment, the EM launcher application utilizes an expendable projectile, that is, it is not just limited to a decoy application but is useful for any other application requiring a launched object to which the armature as shown and described is attachable, such as a firework or other aerial display projectile. As with the decoy embodiment, the expendable projectile embodiments can be used in conjunction with an automatic and/or computerized launching system as described above. The computer launching software program accordingly may include instructions that when executed by the computer cause the launcher to follow a desired sequence, e.g. as with the decoy launch system to "paint" an aerial display as for a fireworks display.

It should be noted that the decoy launching operation software program of the present invention can be carried out by executing one or more sequences of one or more computer-readable instructions read into a memory of one or more computers from volatile or non-volatile computer-readable media capable of storing and/or transferring computer programs or computer-readable instructions for execution by one or more computers. Volatile computer readable media that can be used can include a compact disk, hard disk, floppy disk, tape, magneto-optical disk. PROM (EPROM, EEPROM, flash EPROM), DRAM, SRAM, SDRAM, or any other magnetic medium; punch card, paper tape, or any other physical medium. Non-volatile media can include a memory such as a dynamic memory in a computer. In addition, computer readable media that can be used to store and/or transmit instructions for carrying out methods described herein can include non-physical media such as an electromagnetic carrier wave, acoustic wave, or light wave such as those generated during radio wave and infrared data communications.

Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. An electromagnetic rail gun launcher for launching an armature attached to an electronic countermeasure decoy, comprising:

a barrel, comprising a first main rail and an opposing second main rail defining a bore therebetween, having a breech and a muzzle;

a first augmenting rail positioned outboard of and parallel to the first main rail and separated from the first main rail by an insulator;

a second augmenting rail positioned outboard of and parallel to the first augmenting rail and separated from the first augmenting rail by an insulator;

a third augmenting rail positioned outboard of and parallel to the second main rail and separated from the second main rail by an insulator;

a fourth augmenting rail positioned outboard of and parallel to the third augmenting rail and separated from the third augmenting rail by an insulator;

and wherein each of said augmenting rails substantially extends from the breech to the muzzle;

a first electrically-conducting crossover connecting the first main rail to the third augmenting rail proximate to the breech;

a second electrically-conducting crossover connecting the first augmenting rail to the second main rail proximate to the breech;

a third electrically-conducting crossover connecting the first augmenting rail to the fourth augmenting rail proximate to the muzzle; and a fourth electrically-conducting crossover connecting the second augmenting rail to the third augmenting rail proximate to the muzzle; whereby when current is provided to the rails with the armature positioned in the bore at the breech, a magnetic field is generated and a current is introduced into the armature that is perpendicular to the magnetic field to produce a force on the armature in the direction of the muzzle and thereby propel the armature with attached decoy through the bore and out of the launcher at a selected velocity in a selected direction.

2. The launcher of claim 1, wherein each of said augmenting rails is a laminate.

3. The launcher of claim 2, wherein each of said augmenting rails is a laminate comprising at least three thin conductor layers separated by insulating layers and connected together at their ends.

4. The launcher of claim 1, further comprising electrical means connected to the main rails for powering the launcher.

5. The launcher of claim 4, wherein the electrical means includes a capacitor bank.

6. The launcher of claim 5, wherein the selected velocity is controlled by selecting an amount of charge stored in the capacitor bank.

7. The launcher of claim 4, further comprising a computer having a memory and a computer-readable media programmed with decoy launching software instructions that when executed by the computer cause the computer to control the decoy launch rate and velocity.

8. The launcher of claim 7, wherein the programmed software further includes instructions that when executed by the computer cause the computer to launch a plurality of decoys that form a painted spatial image.

9. The launcher of claim 8, wherein the programmed software further includes instructions that when executed by the computer cause the computer to launch one or more additional decoys that provide an additional electronic countermeasure following the painted spatial image.

10. The launcher of claim 1, wherein the launcher further comprises a copper-tungston alloy block at the breech.

11. The launcher of claim 1, wherein the armature with attached decoy further comprises a lubricant reconditioning pad, containing a lubricant, secured thereto and positioned such that the pad contacts the rails to thereby clean debris from the rails while applying lubricant to the rails as the armature moves through the bore to thereby lubricate and recondition the rails during operation of the rail gun.

12. An electromagnetic rail gun launcher for launching an armature attached to a projectile, comprising:

a barrel, comprising a first main rail and an opposing second main rail defining a bore therebetween, having a breech and a muzzle;

a first pair of augmenting rails, wherein a first augmenting rail of said first pair of augmenting rails is positioned outboard of and parallel to the first main rail and separated therefrom by an insulator, and a second augmenting rail of said first pair of augmenting rails is positioned outboard of and parallel to the second main rail and separated from the first main rail by an insulator;

a second pair of augmenting rails, wherein a first augmenting rail of said second pair of augmenting rails is positioned outboard of and parallel to the first augmenting rail of the first pair of augmenting rails and separated therefrom by an insulator, and a second augmenting rail of said second pair of augmenting rails is positioned outboard of and parallel to the second augmenting rail of the first pair of augmenting rails and separated therefrom by an insulator;

a first pair of electrically-conducting crossovers proximate to the breech and a second pair of electrically-conducting crossovers proximate to the muzzle connected in series whereby when current is provided to the rails with the armature positioned in the bore at the breech, a magnetic field is generated in the bore and a current is introduced into the armature that is perpendicular to the magnetic field to produce a force on the armature in the direction of the muzzle and thereby propel the armature with attached projectile through the bore and out of the launcher at a selected velocity in a selected direction.

13. The launcher of claim 12, further comprising at least one more pair of augmenting rails and at least one more pair of electrically-conducting crossovers configured so as to form a series circuit with the other main rails, augmenting rails, and crossovers when power is applied to the launcher.

14. The launcher of claim 12, wherein the projectile as an electronic countermeasure decoy.

15. The launcher of claim 13, wherein the armature with attached projectile further comprises a lubricant reconditioning pad, containing a lubricant, secured thereto and positioned such that the pad contacts the rails to thereby clean debris from the rails while applying lubricant to the rails as the armature moves through the bore to thereby lubricate and recondition the rails during operation of the rail gun.

16. The launcher of claim 12, wherein the projectile is a firework.

17. The launcher of claim 1, further comprising:

at least one additional pair of augmenting rails, wherein each rail of said at least one additional pair is placed on a mutually opposed outboard side of the launcher coextensive with its adjacent augmenting rail, with an insulator therebetween; and each said at least one additional pair of augmenting rails includes a pair of electrically-conducting crossovers configured in conformity with the other rails and crossovers so as to contribute to the magnetic field.

18. A method of launching an expendable projectile with an armature thereon from an electromagnetic rail gun launcher, wherein said launcher comprises a barrel having a bore therein and a body formed by a pair of main rails and at least one pair of augmenting rails one of each lying outboard of and coextending with each of one of the main rails from a breech to a muzzle, and at least one pair of electrically-conducting crossovers connecting the main rails and the augmenting rails in series with the armature positioned in the bore with power provided to the launcher comprising:

loading the projectile into the breech; and providing power to the railgun whereby a magnetic field is generated in the bore and a current is introduced into the armature perpendicular to the magnetic field so as to produce a force on the armature in the direction of the muzzle and thereby propel the armature with attached projectile through the bore and out of the launcher at a selected velocity in a selected direction.

19. The method of claim 18, wherein the launcher further comprises a computer-controlled launch sequence, and further comprising the step of the computer executing stored software program instructions that control the decoy launch rate and velocity.

20. The launcher of claim 19, further comprising the step of the computer executing stored software program instructions that cause the launch of a plurality of decoys that form a painted spatial image.

21. The launcher of claim 20, further comprising the step of the computer executing stored software program instructions that cause the launch of one or more additional decoys that provide an additional electronic countermeasure following the painted spatial image.

22. The method of claim 18, wherein the projectile is a firework.

* * * * *